United States Patent [19]

Young

[11] Patent Number: 4,685,618

[45] Date of Patent: Aug. 11, 1987

[54] RAIL FASTENING SYSTEMS

[75] Inventor: Hartley F. Young, West Melton, Australia

[73] Assignee: Ralph McKay Limited, Maidstone, Australia

[21] Appl. No.: 823,010

[22] Filed: Jan. 27, 1986

[30] Foreign Application Priority Data

Feb. 1, 1985 [AU] Australia ..... PG 9103

[51] Int. Cl.[4] ..... E01B 9/30

[52] U.S. Cl. ..... 238/310; 238/351

[58] Field of Search ..... 238/287, 297, 304, 310, 238/315, 338, 349, 351, 352

[56] References Cited

FOREIGN PATENT DOCUMENTS 7808040 1/1980 Netherlands ..... 238/349

WO82/00669 3/1982 PCT Int'l. Appl. ..... 238/351

318735 1/1957 Switzerland ..... 238/351

*Primary Examiner*—Randolph A. Reese

*Assistant Examiner*—David F. Hubbuch

*Attorney, Agent, or Firm*—Christel, Bean & Linihan

[57] ABSTRACT

An elastic rail fastening system for use with wooden rail ties in which the rail is seated on a rail plate which in turn is secured to the wooden rail tie by two pairs of spikes which also serve to support two rail clamps. The recessed portions of the spikes are adapted to receive the base portion of the rail clamp. The rail plate has an upstanding rib lying parallel to the rail flange and between each pair of spikes. The arrangement is such that the base of the rail clamp abuts the rail plate rib before it contacts the end of the recess which is adjacent the rail.

4 Claims, 3 Drawing Figures

RAIL FASTENING SYSTEMS

This invention relates to improvements in rail fastening systems particularly a rail fastening system used on wooden sleepers.

Australian Pat. No. 537,442 proposed a novel approach to fastening systems for wooden rail ties whereby a rail plate is provided to lie between the rail and the tie and the rail support plate and is held in position by a pair of attachment means which also hold the elastic rail fasteners in position at right angles to the rails longitudinal direction. The base of the rail fastener seats in opposed recesses of the shoulders of the pair of attachment pegs.

To assemble the rail seat the rail plate is secured in position by the attachment spikes, the rail laid on the support plate between two pairs of attachment means, and two rail fasteners are driven onto the rail flange into the recesses of the attachment means. To force the rail fastener base into the recesses and to carry the bearing portion of the fastener onto the rail flange it is conventional to hammer the fastener into position. A problem has arisen where the person applying the fastener hammers excessively after the fastener is in position. The consequence of such excessive hammering can be the fracture of one or both of the shoulder portions of the attachment means because the base of the rail fastener is driven into the end of the slot in the shoulder of the attachment means which transmits excess hammering force to the spike.

When one attachment spike is fractured it means that a whole rail tie is non functional and it is costly and inconvenient to replace the broken spike.

It is an object of this invention to modify the rail fastening system of Australian Pat. No. 537,442 to avoid this problem.

To this end the present invention provides a rail fastening system comprising a wooden rail tie, a rail having a longitudinal axis, a rail plate positioned between the tie and the rail, two pairs of attachment means associated with each rail plate, each pair being located on opposite sides of the rail and each attachment means is alongside of the rail to secure the plate to the wooden tie, each attachment means including a recess and further having located below the recess, a spike portion extending through the plate and into the tie, and an elastic rail clamp associated with each pair of attachment means, the clamp having one portion lying on the rail flange and another portion held within opposed facing recesses of the associated pair of attachment means wherein the rail plate incorporates an upstanding rib lying between the two attachment means adjacent the rail and the recess in each attachment means is arranged so that the base of the rail clamp abuts the rib of the rail plate before it abuts the end of the recess lying adjacent to the rail.

Basically the rail fastening system is a modification of the system of Australian Pat. No. 537,442. By redesigning the components of the system to ensure the base of the clamp does not abut the end of the recess in the attachment means, accidental hammering of the clip cannot result in fracture of the attachment spike. Impact will occur against the rail plate instead.

As in patent 537,442 it is preferred that the rail clamp incorporates two elastic arms which lie on the rail flange, the arms being integral with a base portion the side edges of which are laterally disposed to the rail and interfit with the complementary recesses in each one of the pair of attachment means.

Preferably the attachment means is in the form of a peg and formed by forging from metal bar or by casting, to have shoulders on one end defining the recess and the spike portion extending between the one end and the opposite end thereof. The recess is generally in the form of a slot open at both ends and along one side and dimensioned to receive the edge of the base portion of the rail clamp.

A preferred form of the invention will now be described with reference to the drawings.

Figure 1:
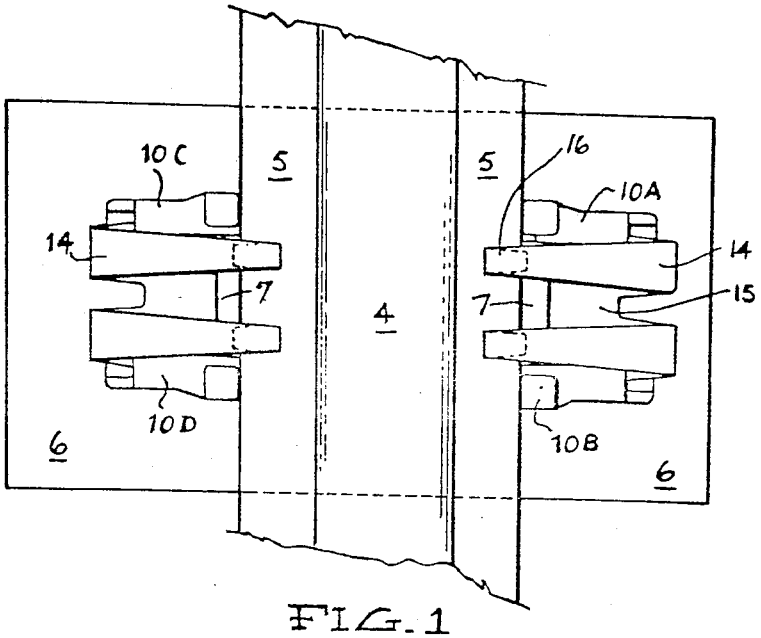
FIG. 1 is a plan view of a rail seat for a wooden rail tie.
Figure 2:
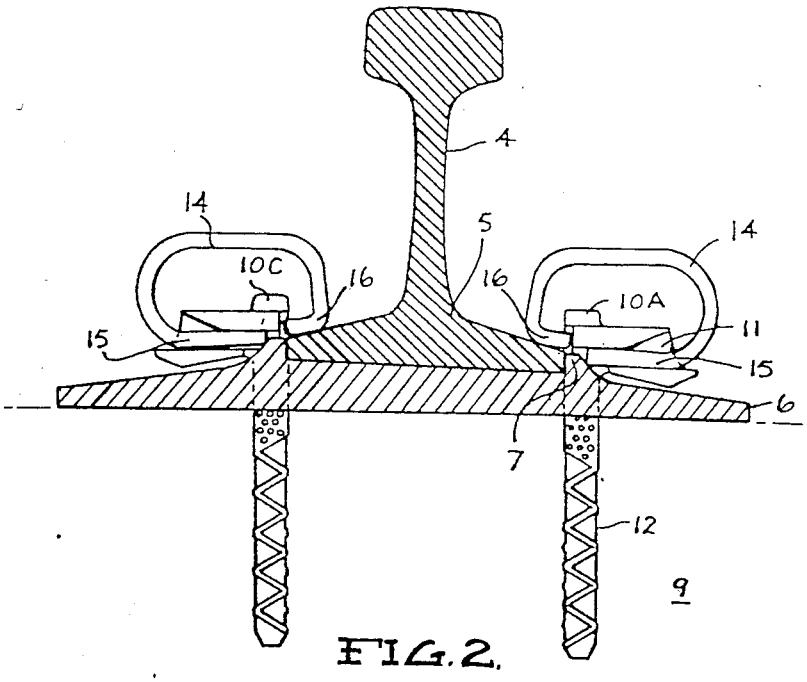
FIG. 2 is a sectional view along the rail of such a rail seat.
Figure 3:
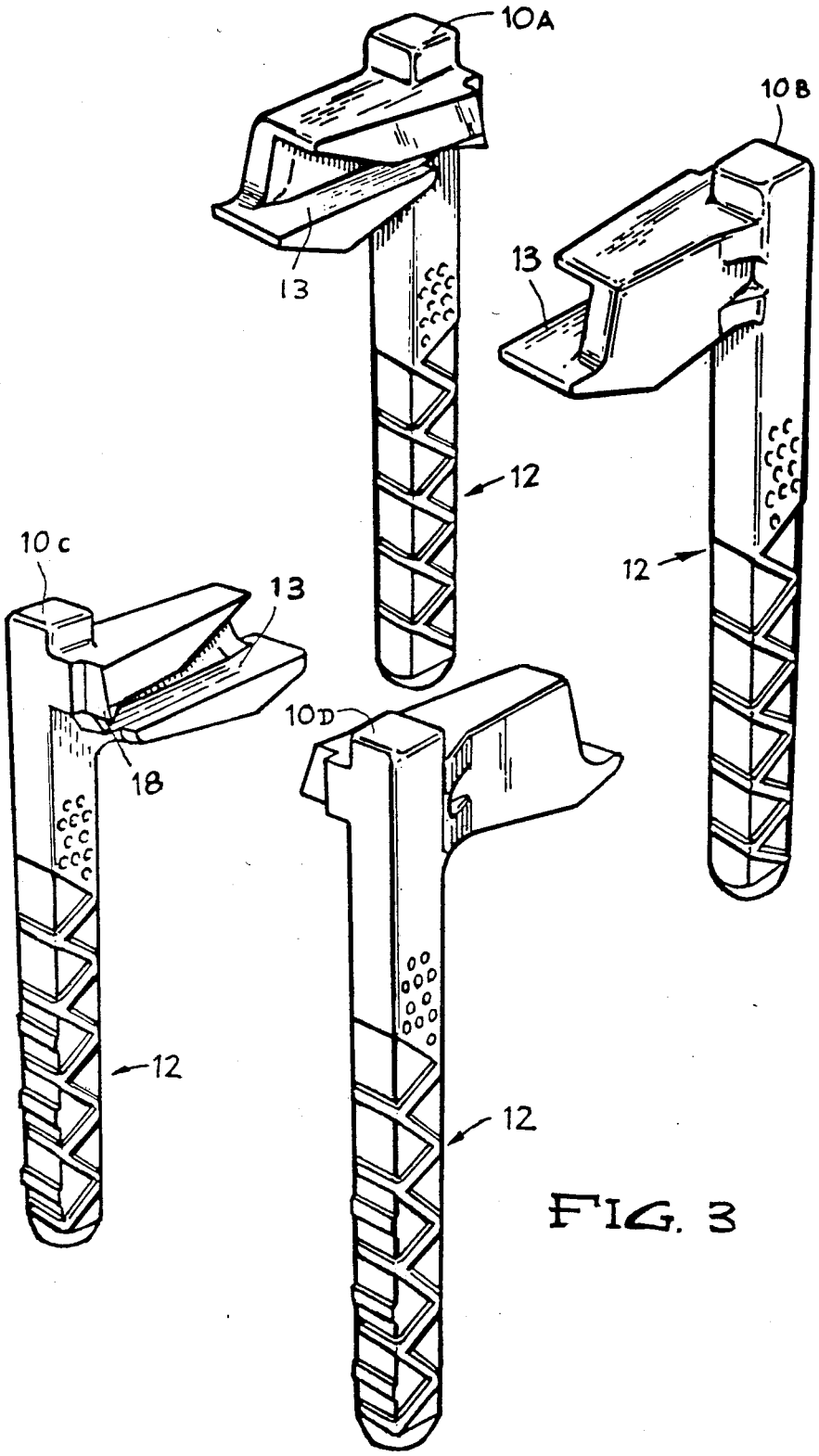
FIG. 3 shows a perspective view of two pairs of attachment means as positioned in a rail seat.

The rail 4 sits on a rail plate 6 which is fastened to the wooden rail tie 9 by the attachment of spikes 10. The spikes 10 extend through complementary holes in the rail plate 6 and the tie attachment portions 12 extend into the wooden tie 9. The rail clamp securing portion 11 lies above the rail plate 6.

The bases 15 of the rail clamps 14 lie within the slots 13 of the pairs of attachment means 10 A and B or 10 C and D.

The toe portions 16 of rail clamps 14 bear down on rail flange 5 to secure the rail 4 in place on the tie 9.

In its normal position on the rail flange 5 the rail clamp 14 is positioned so that the base 15 lying in slots 13 terminates in front of the upstanding rib 7 of rail plate 6. The ribs 7 locate the base of the rail 4 on the rail plate 6. Each of the slots 13 in attachment means 10A, 10B, 10C and 10D terminates in face 18. Each attachment means 10 is so located on rail plate 6 that the end of the base 15 of rail clamp 14 will abut the rib 7 of rail plate 6 before it abuts face 18 at the end of each slot 13. Another important design feature is that the clamp receiving portion does not protrude rearwardly further than the rail clamp 14 so that any blow struck against the rail clamp cannot also strike the receiving portion 11 of the attachment means.

From the above it can be seen that this invention provides a means of avoiding fracture of the attachment means used with wooden rail ties.

The claims defining the invention are as follows:

1. A rail fastening system comprising a wooden rail tie, a rail having a longitudinal axis, a rail plate positioned between the tie and the rail, two pairs of attachment means associated with each rail plate, each pair being located on opposite sides of the rail and each attachment means is alongside of the rail to secure the plate to the wooden tie, each attachment means including a recess, an end of each recess terminating in a surface of the attachment means lying adjacent to the rail, said attachment means further having located below said recess a spike portion extending through the plate and into the tie, and an elastic rail clamp associated with each pair of attachment means, the clamp having one portion lying on the rail flange and a base portion held within opposed facing recesses of the associated pair of attachment means wherein the rail plate incorporates an upstanding rib lying between the two attachment means adjacent the rail and the recess in each attachment means is arranged so that the base portion of the rail clamp abuts said rib of the rail plate before it abuts said surface of said attachment means at the end of the recess when said clamp is moved toward said rail in a direction at about right angles to said rail.

2. A rail fastening system as claimed in claim 1 in which said upstanding rib extends between each pair of attachment means parallel to the rail edge and the two ribs on each rail plate together also serve to locate the rail in its correct position.

3. A rail fastening system as claimed in claim 1 wherein the recess in each attachment means is in the form of an open sided slot dimensioned to receive the edge of the base portion of a rail clamp.

4. A rail fastening system as claimed in claim 1, wherein said attachment means includes a clamp receiving portion containing said recess and said attachment means is so located relative to said clamp that said receiving portion does not extend outwardly beyond said rail clamp in a direction away from said rail so that any blow struck against said clamp cannot also strike said receiving portion of said attachment means.

* * * * *